US008118047B2

(12) United States Patent
Simonson et al.

(10) Patent No.: US 8,118,047 B2
(45) Date of Patent: Feb. 21, 2012

(54) STAKE SYSTEM AND METHOD FOR SOFT MATERIAL

(76) Inventors: Eric M. Simonson, Salt Lake City, UT (US); E. Roger Simonson, Salt Lake City, UT (US)

( * ) Notice: Subject to any disclaimer, the term of this patent is extended or adjusted under 35 U.S.C. 154(b) by 0 days.

(21) Appl. No.: 12/843,580

(22) Filed: Jul. 26, 2010

(65) Prior Publication Data

US 2012/0017959 A1 Jan. 26, 2012

(51) Int. Cl.
*E04H 15/62* (2006.01)

(52) U.S. Cl. ..... 135/118

(58) Field of Classification Search ..... 135/118; 52/153–155

See application file for complete search history.

(56) References Cited

U.S. PATENT DOCUMENTS 412,766 A * 10/1889 Lounsberry ..... 52/154
928,469 A * 7/1909 Miles ..... 135/118
1,724,688 A * 8/1929 Wickstrum ..... 135/118
2,712,864 A * 7/1955 Clevett, Jr. ..... 52/163
3,080,024 A * 3/1963 Clevett ..... 52/155
3,139,163 A * 6/1964 Haller ..... 52/155
3,431,924 A 3/1969 Simpson
3,758,062 A 9/1973 Caldwell et al.
3,766,878 A 10/1973 Hogue
3,788,336 A 1/1974 Steffes
3,814,118 A 6/1974 Larson
3,867,733 A 2/1975 Verlander
4,003,169 A * 1/1977 Young, II ..... 52/155
4,063,567 A 12/1977 Martin et al.
4,337,717 A 7/1982 Gregory
D270,365 S 8/1983 Hawk
4,738,063 A * 4/1988 Alsop ..... 52/163
4,831,798 A 5/1989 Otteson
4,832,304 A 5/1989 Morgulis
4,905,718 A 3/1990 Vandiver
5,122,014 A 6/1992 Genfan
5,123,779 A * 6/1992 Miller ..... 405/19
5,175,966 A * 1/1993 Remke et al. ..... 52/163
5,226,829 A * 7/1993 Jones ..... 135/118
5,322,386 A * 6/1994 Trangsrud ..... 405/19
5,396,743 A 3/1995 Bellette
5,662,134 A 9/1997 Auer
5,699,864 A 12/1997 Dvorak et al.
5,988,194 A 11/1999 Collins
6,301,830 B1 * 10/2001 Whipple ..... 47/43
2003/0024460 A1 2/2003 Militello
2004/0099300 A1 5/2004 Warren
2005/0217188 A1 10/2005 Burns

* cited by examiner

*Primary Examiner* — Noah Chandler Hawk
(74) *Attorney, Agent, or Firm* — David L. Stott

(57) ABSTRACT

Systems, devices and/or methods of a stake system configured to be used in substantially loose material to anchor a stake-down object are provided. In one embodiment, the stake system includes an elongate member and a flexible line. One end of the flexible line is configured to be coupled to a distal portion of the elongate member and is configured to be below an exposed surface of the loose material. The flexible line is sized and configured to cut through the loose material such that at least a portion of the intermediate portion extends tautly away from the elongate member and through the loose material below the exposed surface. With this arrangement, the other end of the flexible line is configured to extend above the loose material and configured to be coupled to the stake-down object.

19 Claims, 5 Drawing Sheets

STAKE SYSTEM AND METHOD FOR SOFT MATERIAL

TECHNICAL FIELD

The present invention relates generally to an anchor or a stake and, more specifically, to stake systems, devices, and methods for anchoring objects in sand or loose material.

BACKGROUND

Prior-art stakes have generally taken the shape of large nails or pegs for various objects to be anchored, such as for tents, sun shades, tarps, etc. The attachment point for such stakes is at the top or top portion of the stake. In mild weather conditions, these prior-art stakes generally secure the object successfully if secured in compacted or somewhat solid soils despite heavy wind conditions. However, in loose, non-compacted sandy soils or sand the prior art stakes completely fail in even the most mild wind conditions. Similar failures occur when anchoring an object in snow. To overcome the issues of anchoring in non-compact material, such as sand or snow, longer stakes have been employed or stakes with auger type ends to provide reinforcement in the non-compact material. Such structures, however, are bulky, costly to manufacture, and add considerable weight to the stake itself, resulting in stakes that are impractical and, with unpredictable weather conditions, will simply not provide sufficient anchoring resistance in such non-compact material.

Therefore, based on the foregoing, it would be advantageous to provide a light-weight stake with a minimal footprint that is cost efficient to manufacture and provides considerable anchoring force in loose, non-compacted material, such as sand or snow.

BRIEF SUMMARY OF THE INVENTION

The present invention is directed to systems, devices and methods of a stake system configured to be used in substantially loose material to anchor a stake-down object. In accordance with one embodiment, the stake system includes an elongate member and a flexible line. The elongate member includes a longitudinal length extending between a proximal end and a distal end. The elongate member also includes a distal portion proximate to the distal end, wherein at least the distal portion is configured to be forced and positioned into the loose material. The flexible line includes a first end and a second end with an intermediate portion therebetween. The first end of the flexible line is configured to be coupled to the distal portion of the elongate member and is configured to be below an exposed surface of the loose material. The flexible line is sized and configured to cut through the loose material such that at least a portion of the intermediate portion extends tautly away from the elongate member and through the loose material below the exposed surface. With this arrangement, the second end of the flexible line is configured to extend above the loose material and configured to be coupled to the stake-down object.

In one embodiment, the flexible line is coupled distal to about a mid-point of the elongate member, wherein the mid-point is defined as half the longitudinal length of the elongate member. In another embodiment, the first end of the flexible line is coupled to the elongate member at a location closer to the distal end than the proximal end of the elongate member. In still another embodiment, the distal portion of the elongate member includes an opening defined therein, the opening sized and configured to receive the first end of the flexible line.

In another embodiment, the elongate member comprises a lateral extension at the distal portion of the elongate member. The flexible line may be configured to be removably coupled to the distal portion of the elongate member adjacent the lateral extension. In still another embodiment, the distal portion of the elongate member includes a paddle configuration.

In still another embodiment, the elongate member includes a cross-section with multiple ribs extending laterally relative to a longitudinal axis of the elongate member to generally define a "Y" configuration. In another embodiment, the elongate member includes at least one bend in a surface along at least a portion of the longitudinal length. The flexible line may include a coupling member configured to seat within the at least one bend at the distal portion of the elongate member.

In one embodiment, the flexible line is configured to extend from the elongate member, upon being placed in a use-position within the loose material, at an angle relative to the elongate member, the angle ranging between about 60 degrees and about 120 degrees. Such flexible line may be at least one of a metal line or a polymer line.

In accordance with another embodiment of the present invention, a staking system may be used in substantially loose material. The staking system includes a stake-down object and a plurality of anchor systems. The stake-down object is at least partially positioned above ground level. Each of the plurality of anchor systems include an elongate member and a flexible line. The elongate member includes a longitudinal length extending between a proximal end and a distal end, the elongate member including a distal portion proximate to the distal end, wherein at least the distal portion is configured to be forced and positioned into the loose material. The flexible line includes a first end and a second end with an intermediate portion therebetween. The first end is configured to be coupled to the distal portion of the elongate member and is configured to be below an exposed surface of the loose material. The flexible line is sized and configured to cut through the loose material such that at least a portion of the intermediate portion extends tautly away from the elongate member and through the loose material below the exposed surface. With this arrangement, the second end of the flexible line is configured to extend above the loose material and is configured to be coupled to the stake-down object.

In one embodiment, the elongate member includes a bent profile so as to facilitate each elongate member of the plurality of anchor systems to be stored compactly together in a nested arrangement. In another embodiment, the elongate member includes a paddle configuration at the distal portion of the elongate member. In still another embodiment, the distal portion of the elongate member includes an opening defined therein, the opening sized and configured to receive the first end of the flexible line. In another embodiment, the flexible line includes at least one of a metal line or a polymer line. In one embodiment, the flexible line is configured to be removably coupled to the distal portion of the elongate member.

In accordance with another embodiment of the present invention, a method of staking in loose material is provided. The method includes providing an elongate member and a flexible line, the elongate member having a proximal end and a distal end, the flexible line including a first end and a second end with an intermediate portion therebetween, the first end configured to be coupled to a distal portion of the elongate member proximate to the distal end of the elongate member; coupling the second end of the flexible line to a stake-down object; forcing the distal end of the elongate member and the flexible line into the loose material a distance from the stake-down object; and cutting through the loose material with the flexible line with the first end of the flexible line below a surface of the loose material and with a portion of the flexible line extending away from the elongate member and through the loose material toward the tie-down and with the second end exposed above the surface of the loose material. In one embodiment, the method includes coupling the first end of the flexible line to the distal portion of the elongate member.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
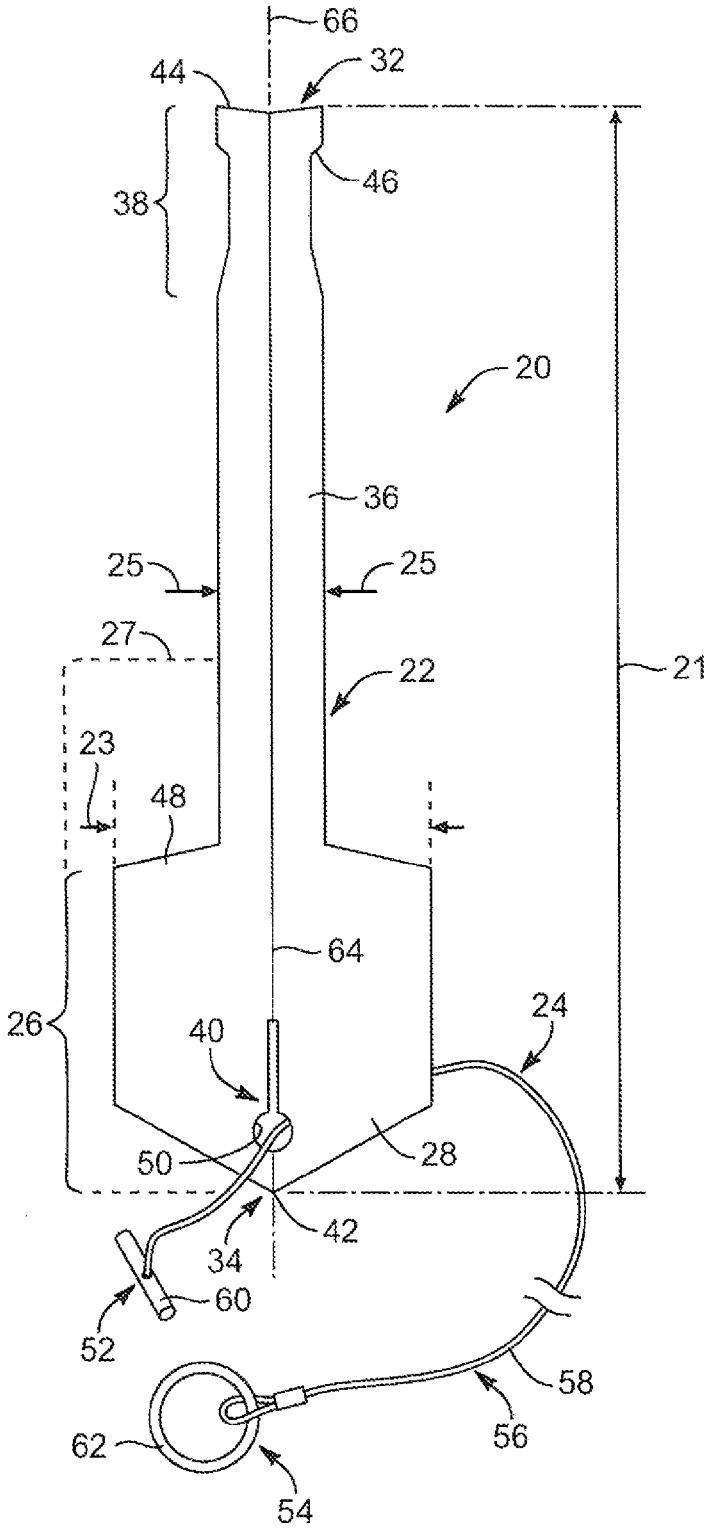
FIG. 1 is a front view of a stake system having an elongate member and a flexible line, according to an embodiment of the present invention.
Figure 4A:
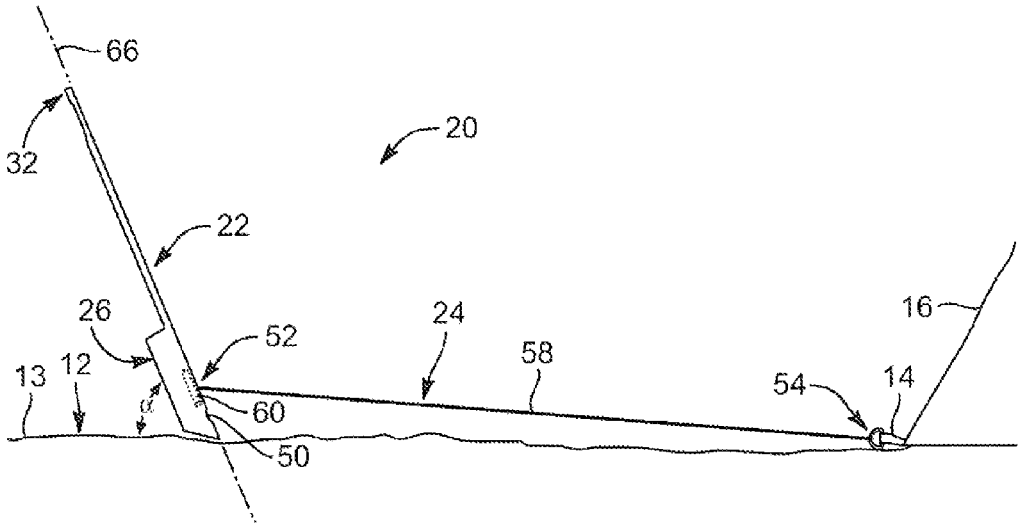
FIG. 4A is a side view of the stake system and a stake-down object, depicting the elongate member and flexible line disposed above a loose material in a pre-use position, according to one embodiment of the present invention.
Figure 4B:
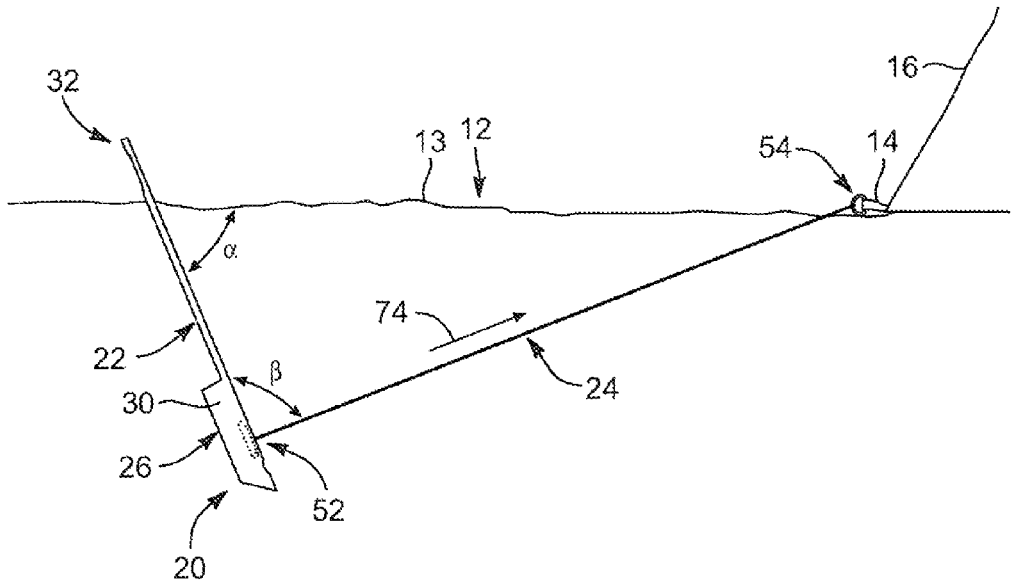
FIG. 4B is a side view of the stake system and a stake-down object, depicting the elongate member and flexible line disposed within the loose material in a use position, according to another embodiment of the present invention.

Referring to FIGS. 1 and 4B, an anchoring or stake system 20 is shown. Such a stake system 20 may include an elongate member 22 (or otherwise termed a stake or anchor) and a flexible line 24. The stake system 20 may be configured to provide anchoring resistance for a stake-down object 16 in soft or loose material 12, such as sand or sandy soils. Other soft or loose materials 12 may include snow or any other soft or loose material, such as gravel, loose dirt, or other fine aggregate. The stake-down object 16 or objects that may be employed with the stake system 20 of the present invention may include tents, tarps, trees, shrubs, sun shades, boats or snow/ice climbing devices that may need to be anchored in loose material 12, as set forth above, or any other object that may be anchored in loose material 12. As shown in the drawings and as described throughout the following description, as is traditional when referring to relative positioning on an object, the term "proximal" refers to the end portion of the apparatus which is closer to the user and the term "distal" refers to the end portion of the apparatus which is further from the user in the normal use of such apparatus. For example, relative to the elongate member 22 or stake disclosed herein, the proximal end portion of the elongate member 22 is the portion that a user would strike with a hammer and the distal end portion of the elongate member is the portion that may include a spike end, or the like, that is driven below the surface of the ground.

The stake system 20 disclosed herein may be termed a deep anchoring system that, as previously set forth, may include the elongate member 22 and the flexible line 24. Such a flexible line 24 may be sized and configured to be coupled to the elongate member 22 at a distal portion 26 thereof. The distal portion 26 of the elongate member 22, with the flexible line 24 coupled thereto, may be configured to be pounded or forced into a soft or loose material 12, for example, sand. Due to the loose nature of sand, the flexible line 24 can cut through the sand such that the coupled end and a portion of the flexible line 24 extend away from the elongate member 22 through the sand and toward the object being staked down. The other end of the flexible line 24 may be exposed above the sand to attach or couple to the stake-down object 16, for example, a tent. Such coupling to the stake-down object 16 may include directly coupling to a tie-down 14 or a guy-line. With this arrangement, the flexible line 24 extending through the loose material and being coupled to the distal portion 26 of the elongate member 22 provides a deep anchoring system with greater pull-out resistance than that of conventional stakes so as to facilitate anchoring in loose material 12, such as sand.

Figure 2:
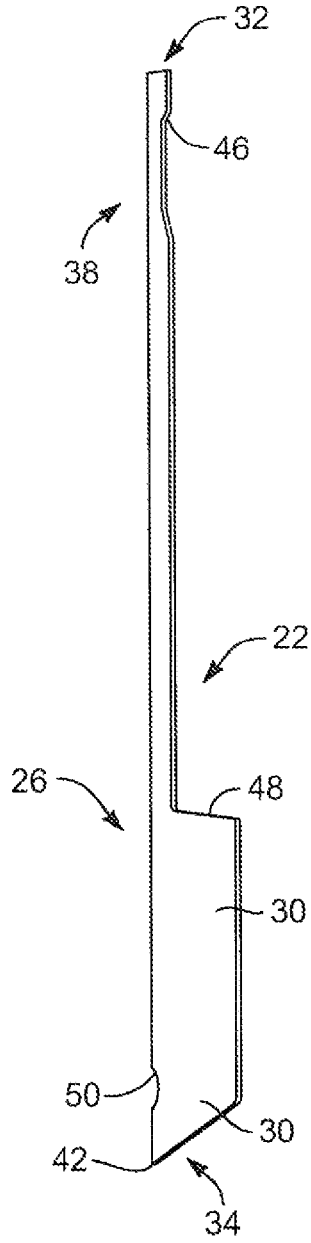
FIG. 2 is a side view of the elongate member of the stake system, according to the present invention.
Figure 3:
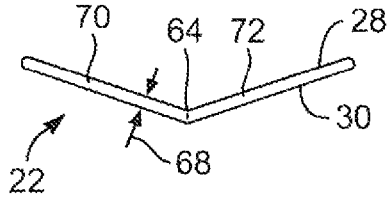
FIG. 3 is an end view of the elongate member of the stake system, according to the present invention.

With reference to FIGS. 1 through 3, in one embodiment, the elongate member 22 may include a first side surface 28 and a second side surface 30 each extending along a longitudinal length 21 and a width of the elongate member 22. The longitudinal length 21 may extend between a proximal end 32 and a distal end 34 of the elongate member 22. The width of the elongate member 22 may vary along one or more portions of the longitudinal length 21 of the elongate member 22. The elongate member 22 may include the distal portion 26, an intermediate extension 36 and a proximal portion 38. In one embodiment, the distal portion 26 may extend between about a midpoint 27 of the elongate member 22 to the distal end 34 of the elongate member 22, the midpoint 27 being defined as one-half the longitudinal length 21 of the elongate member 22. The distal portion 26 may include a coupling portion 40 sized and configured to couple to the flexible line 24. Further, the distal portion 26 may include a distal point 42 along an end surface of the distal portion 26, the distal point 42 configured to be initially forced in the ground or loose material 12. In another embodiment, the end surface or distal end 34 may be flat, without the distal point.

The intermediate extension 36 may extend various lengths between the distal portion 26 and the proximal portion 38 depending on the desired length of the elongate member 22.

The proximal portion 38 may include a proximal end surface 44 configured to be pounded or forced downward and may be left exposed above the ground or loose material 12. The proximal portion 38 may also define one or more notches 46 to facilitate pulling the elongate member from the ground for removal therefrom.

In one embodiment, the distal portion 26 may include a lateral extension 48, extending laterally relative to the longitudinal length 21, similar to a paddle or wing configuration. The lateral extension 48 may provide a first width 23 that is greater than a second width 25 at the intermediate extension 36 of the elongate member 22. The lateral extension 48 may include various forms and may include an enlarged surface area per unit length relative to the intermediate extension 36 such that the first width 23 of the lateral extension 48 is greater than the second width 25 immediately proximal the lateral extension 48.

The distal portion 26 of the elongate member 22, as previously set forth, may include the coupling portion 40. In one embodiment, such a coupling portion 40 may be in the form of an opening 50 defined in the elongate member 22 and extending therethrough. The opening 50 may define a circular shape with a slot extending therefrom. Such an opening 50 may be sized and configured to reversibly couple with one end of the flexible line 24. Other coupling configurations may be employed, as known to one of ordinary skill in the art. For example, the coupling portion 40 may be in the form of a protrusion or hook that may latch or couple to a looped end (not shown) of the flexible line 24. The coupling between the flexible line 24 and the elongate member 22 may also be a permanent coupling so that the flexible line 24 remains fixed to the elongate member 22. Importantly, the flexible line 24 should be coupled to the elongate member 22 at a position along the length of the elongate member 22 that positions the flexible line 22 within the loose material 12. In one embodiment, the coupling portion 40 may be distal to at least the midpoint 27 of the elongate member 22. In other words, the flexible line 24 may couple to the elongate member 22 at any point between the midpoint 27 and the distal end 34 of the elongate member 22.

The flexible line 24 may include a first end 52 and a second end 54 with an intermediate portion 56 therebetween. In one embodiment, the flexible line 24 may include a line 58 with a coupling member 60 at the first end 52 and another coupling element, such as a ring 62 at the second end 54. The ring 62 at the second end 54 of the flexible line 24 may be employed to couple to a tie-down 14 or a guy-line of, for example, a tent or any other suitable stake-down object 16, as previously set forth. The coupling member 60 may be rod-like or a cylindrical like member with one end of the line 58 connected thereto. To couple the first end 52 of the flexible line 24 to the elongate member 22, one end of the coupling member 60 may be inserted through the circular shaped portion of the opening 50 with the line 58 so that the line 58 may slide up the slot portion of the opening 50. With this arrangement, the flexible line 24 may then be pulled tautly to bias or seat the coupling member 60 against a first side surface 28 of the distal portion 26 of the elongate member 22, thereby, coupling the first end 52 of the flexible line 24 to the elongate member 22. It should be noted that although a rod-like coupling member 60 may be used, other shapes for a coupling member 60 may also be used such as a sphere shaped member or a disc shaped member or any other suitable coupling member known in the art, some of which may be employed with different shaped openings 50 defined in the distal portion 26 of the elongate member 22.

The line 58 of the flexible line 24 may be made from a metal or high-strength polymer material or a combination of both, or any other suitable material that is flexible and relatively thin that can cut through soft or loose material 12, such as sand or snow. The line 58 can be wire-like and may be braided into a cable like structure or be made from a single high-strength and flexible line. Other materials for the line 58 may also be employed as known to one of ordinary skill in the art.

In another embodiment, the elongate member 22 may define a bend 64 along the longitudinal length 21 of the elongate member 22. The bend 64 may extend along the entire length or along a portion of the length, such as along the distal portion 26 of the elongate member 22. Further, the bend 64 may extend along an axis 66 or center line of the elongate member 22 and along the longitudinal length 21. The bend 64 in the first side surface 28 of the distal portion 26 of the elongate member 22 may be employed to seat the coupling member 60 against or within the bend 64 when the flexible line 24 is pulled taut, thereby, centering the coupling member 60 relative to the elongate member 22. As known by one of ordinary skill in the art, other structures may be employed without departing from the spirit and scope of the present invention that centers or aligns the flexible line 24, upon being placed in a taut position, relative to the elongate member 22.

As depicted in FIG. 3, an end view of the elongate member 22 is shown. The first side surface 28 of the elongate member 22 may be the surface facing upward and the second side surface 30 may be the surface facing downward. The second side surface 30 of the elongate member 22 may define a peak at the bend 64 and along the distal portion 26 or along the length of the elongate member 22. The elongate member 22 may include a substantially flat structure defining a depth dimension 68 between the first side surface 28 and the second side surface 30. In an embodiment with the bend 64, such bend 64 may define a first side 70 (left side) and a second side 72 (right side) of the elongate member 22.

In another embodiment, the elongate member 22 may define a lateral bend (not shown) that extends laterally relative to the axis 66 of the elongate member 22. For example, a lateral bend may be employed to further stabilize the elongate member 22, such as including a bend extending lateral to the longitudinal length 21 in, for example, the proximal portion 38 of the elongate member such that, in the use position, a proximal portion exposed above the loose material extends away from the direction of the flexible line. In this manner, the proximal portion of the elongate member may be employed as a pounding surface at the bend, the elongate member being forced into the loose material until the proximal portion that is bent is flush with the loose material. The proximal portion of the elongate member being flush with the loose material may further increase the pull-out resistance with an underside of the bent proximal portion having leverage against the surface of the loose material.

In one embodiment, the elongate member may be made from aluminum, steel, stainless steel, titanium or composites or combinations thereof or any other suitable metals or combination of metals or composites. In another embodiment, the elongate member may be made from a polymeric material of types known in the art. The elongate member may be manufactured utilizing known processes of fabrication and/or molding, such as stamping, laser cutting or injected molding in the case of employing a polymeric elongate member or any other known polymeric molding process, as known to one of ordinary skill in the art.

FIGS. 4A and 4B depict the stake system 20 of the present invention being employed within the loose material 12, such as sand, for anchoring a stake-down object 16, such as a tent. With respect to FIG. 4A, a user of the stake system 20 may couple the second end 54 of the flexible line 24 to a tie-down 14 of the stake-down object 16. The user may then couple the first end 52 of the flexible line 24 to the elongate member 22 so that the coupling member 60 (shown in outline form) is positioned within the bend (not shown) on the first side surface 28 of the elongate member 22 and the line 58 is positioned at a top-end of the slot of the opening 50 defined in the distal portion 26 of the elongate member 22. The elongate member 22 may then be positioned a distance away from the tie-down 14 so that the flexible line 24 is taught. Also, the elongate member 22 may be oriented relative to a surface 13 of the loose material 12 at an angle α. The angle α may range between about 20 degrees to about 90 degrees, however, other angles may also be acceptable as the more important component in the deep anchoring system is the angle from which the flexible line 24 extends from the elongate member 22, discussed in detail below with respect to FIG. 4B.

Further, with respect to FIG. 4A, when pulling the elongate member 22 to place the flexible line 24 in the taut position, care should be taken that the second side surface 30 of the elongate member 22 is oriented to face the tie down 14 at the angle α or, in other words, the elongate member 22 should not be skewed or rotated relative to axis 66 of the elongate member 22 when placing the elongate member 22 in the orientation prior to forcing the elongate member 22 into the loose material 12. At this stage, a user may then place their knee or foot on the flexible line 24 at, or adjacent to, the second end 54 thereof to maintain the tautness of the flexible line 24 while forcing the elongate member 22 into the loose material 12. The user may then employ a hammer or mallet to force or drive the elongate member 22 into the loose material 12 by pounding on the proximal end 32 of the elongate member 22.

As depicted in FIG. 4B, the taut flexible line 24 is configured to cut through or slice through the loose material 12 as the elongate member 22 is driven into the loose material 12. In the final use-position, the flexible line 24 may extend directly away from the elongate member 22 toward the stake-down object 16 at an angle β. The angle β is defined as the angle between the elongate member 22 and the flexible line 24 when the stake system 20 is in the use position. For maximum performance, the angle β may be preferably about 90 degrees. Other angles for angle β that provide acceptable resistance may range between about 60 degrees and about 120 degrees. Further, other angles for angle β that may be employed may range between about 45 degrees and about 135 degrees. In this manner, the stake system 20, including the flexible line 24 coupled to the distal portion 26 of the elongate member 22, acts as a deep anchoring system that provides a pull-force resistance allowing one to readily anchor in loose material 12, such as sand. Further, the surface area of the lateral extensions 48 and the second side surface 30 of the elongate member 22 that is concealed or below the exposed surface 13 of the loose material 12 provides resistance from being pulled through the loose material 12 with a directional force 74 provided through the taught flexible line 24 being placed on the elongate member 22 at the distal portion 26 thereof and adjacent the lateral extensions 48 below the surface of the loose material 12. Furthermore, in another embodiment, the bend (not shown) along the length and axis 66 of the elongate member 22 may automatically center and orient the second side surface 30 of the elongate member 22 relative to the directional force 74 in the taut flexible line 24. Proper orientation of the second side surface 30 relative to the flexible line 24 may increase the pull-through resistance of the elongate member 22 due to maximizing the surface area of the second side surface 30 of the elongate member 20 facing the directional force 74 of the flexible line 24. In this manner, the preferred angle β is about 90 degrees, but other angles may also provide acceptable resistance, as previously set forth. With this arrangement, the stake system 20, including the elongate member 22 and flexible line 24, may be employed in loose material 12 to anchor a stake-down object 16.

Furthermore, in another embodiment, the stake system may be employed by attaching the second end of the stake-down object after forcing the elongate member into the loose material. For example, the first end 52 of the flexible line 24 may be coupled to the distal portion 26 of the elongate member 22. The elongate member 22 may then be forced into the loose material 12 by, for example, pounding on the proximal end 32 with a mallet, with a portion of the flexible line 24 also being forced into the loose material 12. The user can then pull the second end 54 of the flexible line 24 toward the tie-down 14 of the stake-down object 16, thereby, pulling the flexible line 24 taut to cut or slice through the loose material 12 to extend in the direction of the tie-down 14. The user can then couple the second end 54 of the flexible line 24 to the stake-down object 16 with a portion of the flexible line extending through the loose material, as depicted in FIG. 4B.

Figure 5:
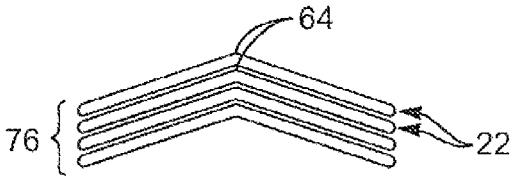
FIG. 5 is an end view of multiple elongate members in a compact, nested arrangement, according to another embodiment of the present invention.

With reference now to FIG. 5, in another embodiment, the elongate member 22 may include the bend 64, as previously set forth, along at least a portion of the longitudinal length of the elongate member 22 to readily facilitate a nested arrangement 76 with other elongate members 22. As depicted, a plurality of elongate members 22 may be nested together to allow a user to maintain the plurality of elongate members 22 together with a minimal foot-print. Such minimal foot-print facilitates greater portability in maintaining the plurality of elongate members 22 in a compact manner or the nested arrangement 76.

Figure 6:
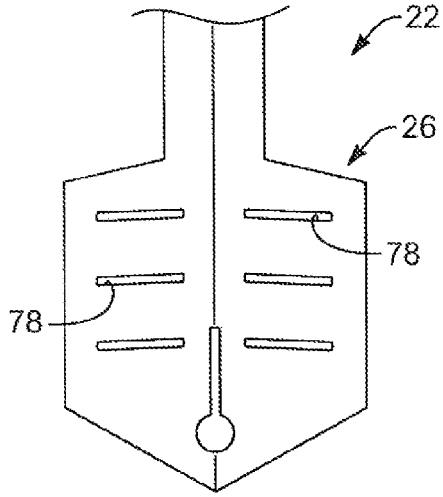
FIG. 6 is a partial front view of an elongate member with multiple slots defined in the elongate member, according to another embodiment of the present invention.

In another embodiment, with respect to FIG. 6, the distal portion 26 of the elongate member 22 may include one or more secondary openings 78 defined therein. The secondary openings 78 may extend through the elongate member 22 and may be in the form of, for example, slots within the elongate member 22 or any other suitable shaped secondary openings 78. In one embodiment, the secondary openings 78 may extend laterally relative to the longitudinal length of the elongate member 22. In another embodiment, the secondary openings 78 may extend vertically or diagonally relative to the longitudinal length of the elongate member 22. In still another embodiment, the secondary openings 78 may be circular or oval holes or define a curve-linear slot within the elongate member 22.

The secondary openings 78 may be useful for being employed in loose material, such as snow. In particular, for example, upon the elongate member 22 being forced in a loose material, such as snow, the snow may melt so that water may collect within and along the secondary openings 78 and then turn to ice. The ice within and along the secondary openings 78 may provide an increase in the pull-through resistance. In this manner, the elongate member 22 may include one or more secondary openings 78 in the distal portion 26 and/or along other portions of the elongate member 22 to maximize the potential pull-through resistance of the elongate member 22.

Figure 7:
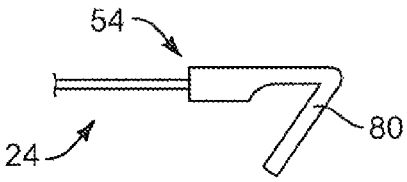
FIG. 7 is an enlarged side view of one end of the flexible line, according to another embodiment of the present invention.
Figure 8:
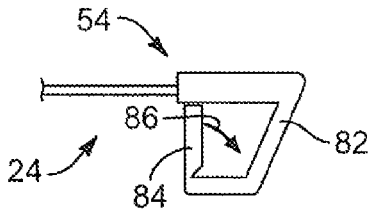
FIG. 8 is an enlarged side view of one end of the flexible line, according to another embodiment of the present invention.

With respect to FIGS. 7 and 8, other embodiments are shown that may be employed at the second end 54 of the flexible line 24 to couple to a tie-down 14 (or guy-line) or coupled directly to a stake-down object 16 (see FIG. 4A). For example, FIG. 7 illustrates a hook structure 80 that may be fixed at the second end 54 of the flexible line 24. FIG. 8 shows a latch structure 82 fixed at the second end 54 of the flexible line 24. The latch structure 82 may include an extension 84 that pivots, as depicted by arrow 86. As known by one of ordinary skill in the art, other suitable structures may be utilized for coupling to a stake-down object.

Figure 9:
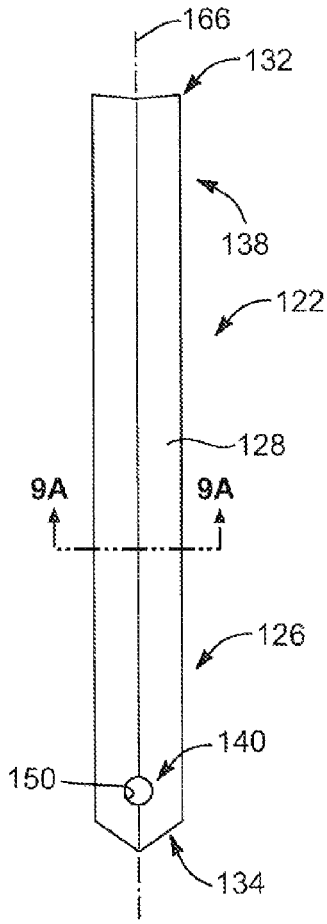
FIG. 9 is a front view of an elongate member, according to another embodiment of the present invention.
Figure 9A:
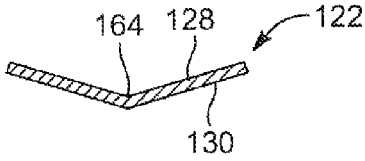
FIG. 9A is an enlarged cross-sectional view taken along section line 9A of FIG. 9, according to the present invention.

With reference to FIGS. 9 and 9A, another embodiment of an elongate member 122 is shown, FIG. 9A being a cross-sectional view taken along section line 9A of FIG. 9. In this embodiment, the elongate member 122 is similar to the embodiment depicted in FIG. 1, except in this embodiment, the elongate member 122 may include a substantially constant width along the longitudinal length. The elongate member 122 may include a first side surface 128 and a second side surface 130 extending between a proximal end 132 and a distal end 134 with a bend 164 along an axis 166 or center line of the elongate member 122. Further, the elongate member 122 may include a coupling portion 140 defined as an opening 150 in distal portion 126 of the elongate member 122 sized and configured to couple with the flexible line (not shown), similar to that described previously. Further, a proximal portion 138 of the elongate member 122 may include notches (not shown) along one or both sides of the elongate member 122 to facilitate pulling the elongate member 122 from the loose material, such as the sand.

Figure 10:
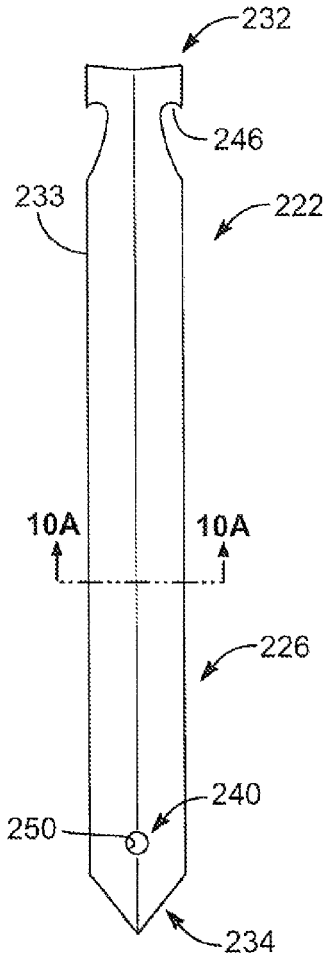
FIG. 10 is a front view of an elongate member, according to another embodiment of the present invention.
Figure 10A:
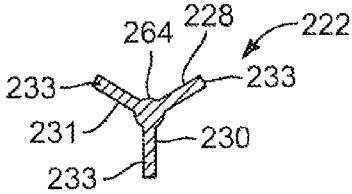
FIG. 10A is a cross-sectional view taken along section line 10A of FIG. 10, according to the present invention.

With reference to FIGS. 10 and 10A, another embodiment of an elongate member 222 is shown, FIG. 10A being a cross-sectional view of the elongate member 222 taken along section line 10A of FIG. 10. The elongate member 222, in this embodiment, may include a tri-wing configuration or a "Y" configuration, as depicted in FIG. 10A. As such, the elongate member 222 may include a first side surface 228, a second side surface 230 and a third side surface 231 each defined by ribs 233 that may extend between a proximal end 232 and a distal end 234 along the longitudinal length of the elongate member 222 and extend laterally relative to a longitudinal axis of the elongate member 222. As in the previous embodiments, the elongate member 222 may include a coupling portion 240 or opening 250 defined in a distal portion 226 of the elongate member 222. Such opening 250 may be sized and configured to receive a first end of a flexible line (not shown) so that, for example, a coupling member (not shown) may be disposed within a bend 264 in the first side surface 228 to center and align the elongate member 222 when being forced into the loose material, as previously discussed herein. Adjacent to the proximal end 232, the elongate member 222 may include notches 246 defined in the ribs 233 to facilitate pulling the elongate member 222 from the loose material. Further, in another embodiment, the distal portion 226 may include a lateral extension (not shown) such that the ribs 233 extend laterally to enlarge the surface area of the distal portion 226 (similar to the lateral extension 48 depicted in FIG. 1).

Figure 11:
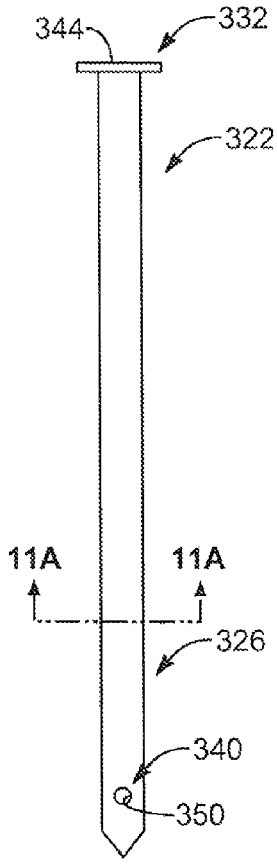
FIG. 11 is a front view of an elongate member, according to another embodiment of the present invention.
Figure 11A:
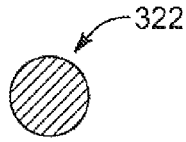
FIG. 11A is a cross-sectional view taken along section 11A of FIG. 11, according to the present invention.

Referring now to FIGS. 11 and 11A, another embodiment of an elongate member 322 is shown. In this embodiment, the elongate member 322 may include a circular cross-section, shown in FIG. 11A, taken from section line 11A of FIG. 11. Similar to previous embodiments, the elongate member 322 of this embodiment may include a coupling portion 340 or opening 350 defined in a distal portion 326 of the elongate member 322 for coupling to a flexible line (not shown). At a proximal end 332 of the elongate member 322, the elongate member 322 may include a proximal end surface 344 sized and configured to receive pounding for forcing the elongate member 322 into the loose material to place the elongate member 332 and flexible line in the use-position. This embodiment may also include a lateral extension (not shown) or wing configuration at the distal portion 326 of the elongate member 322.

Figure 12:
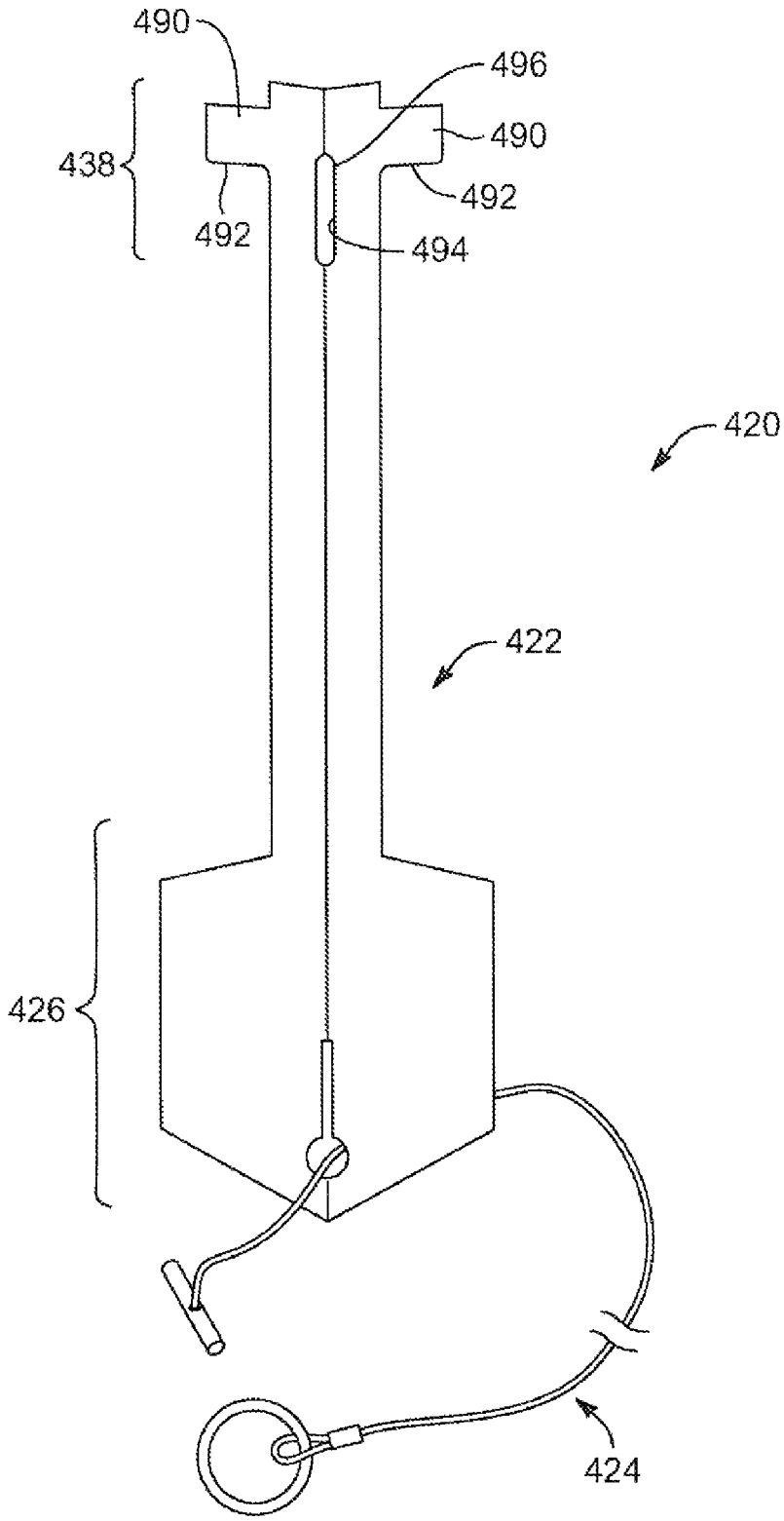
FIG. 12 is a front view of a stake system with an elongate member and a flexible line, depicting the elongate member having a T-configuration at a proximal portion thereof, according to another embodiment of the present invention.

With respect to FIG. 12, another embodiment of the stake system 420 is shown. This embodiment is similar to the previous embodiments and more specifically to the embodiment depicted and described relative to FIG. 1. However, in this embodiment, the elongate member 422 or stake may include a T-configuration at a proximal portion 438 thereof. As in the previous embodiments, the stake system 420 of this embodiment may include the elongate member 422 and a flexible line 424, the flexible line 424 configured to be coupled to the distal portion 426 of the elongate member 422. In this embodiment, the proximal portion 438 of the elongate member 422 may include the T-configuration or one or more proximal lateral tabs 490. The tabs 490 may extend laterally relative to the longitudinal length of the elongate member 422 at the proximal portion 438 of the elongate member 422 to define an under-side surface 492 of the tab. Further, the elongate member 422 may include a hole 494 defined in the elongate member 422 at the proximal portion 438 of the elongate member 422. The hole 494 may extend through the depth of the elongate member 422 to include a hole periphery 496 defined in the elongate member 422. The hole 494 may be sized and configured to receive one of the lateral tabs 490 of another elongate member 422. For example, when it is desired to remove the stake system 420 from the ground, the hole 494 defined in the elongate member 422 may be exposed above ground level to allow a user to insert the tab 490 of another elongate member 422 into the hole 494 to abut the under-side surface 492 of the tab 490 against the hole periphery 496. The user can then pull upward, thereby, pulling the stake system 420 from the ground. In this manner, the tab 490 and hole 494 arrangement in the proximal portion 438 of the elongate member 422 may be employed to more easily remove the stake system 420 from the ground. Alternatively, the stake system 420 may be removed from the ground (without the above-described hole) by placing the under-side surface 492 of one elongate member 422 under the under-side surface 492 of another elongate member 422 that is partially exposed in the ground for leverage therebetween. The user can then readily pull the partially exposed elongate member from the ground via the tabs 490 of the two elongate members 422.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. For example, the tabs 490 of FIG. 12 may be included in any one of the embodiments of the elongate member described herein. As such, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A stake system configured to be used in substantially loose material to anchor a stake-down object, the stake system comprising:

a stake member including a longitudinal length extending between a proximal end and a distal end, the stake member including a distal portion proximate to the distal end and an elongated portion longitudinally extending between the distal portion and the proximal end, the elongated portion being longitudinally longer than the distal portion, the elongated portion being integrally formed with the distal portion, the distal portion defining a first lateral width and the elongated portion defining a second lateral width, the first lateral width being larger than the second lateral width, the distal portion and at least a portion of the elongated portion configured to be forced and positioned into the loose material with the proximal end configured to remain exposed above a surface of the loose material; and a flexible line having a first end and a second end with an intermediate portion therebetween, the first end configured to be coupled to the distal portion of the stake member and configured to be below the exposed surface of the loose material, the flexible line sized and configured to cut through the loose material such that at least a portion of the intermediate portion extends tautly away from the stake member and through the loose material below the exposed surface, the second end configured to extend above the loose material and configured to be coupled to the stake-down object;

wherein the stake member is configured to substantially maintain a constant orientation relative to the exposed surface of the loose material upon the stake member being forced into the loose material and upon the flexible line being extended tautly away from the stake member at an angle ranging between about 45 degrees and about 135 degrees.

2. The stake system of claim 1, wherein the flexible line is coupled distal to about a mid-point of the stake member, the mid-point defined as half the longitudinal length of the stake member.

3. The stake system of claim 1, wherein the first end of the flexible line is coupled to the stake member at a location closer to the distal end than the proximal end of the stake member.

4. The stake system of claim 1, wherein the distal portion of the stake member comprises an opening defined therein, the opening sized and configured to receive the first end of the flexible line.

5. The stake system of claim 1, wherein the stake member comprises a lateral extension in part defining the first lateral width at the distal portion of the stake member.

6. The stake system of claim 5, wherein the flexible line is configured to be removably coupled to the distal portion of the stake member adjacent the lateral extension.

7. The stake system of claim 1, wherein the distal portion of the stake member comprises a paddle configuration.

8. The stake system of claim 1, wherein the stake member comprises at least one bend in a surface along at least a portion of the longitudinal length.

9. The stake system of claim 8, wherein the flexible line comprises a coupling member configured to seat within the at least one bend at the distal portion of the stake member.

10. The stake system of claim 1, wherein the flexible line is configured to extend from the stake member, upon being placed in a use-position within the loose material, at an angle relative to the stake member, the angle ranging between about 60 degrees and about 120 degrees.

11. The stake system of claim 1, wherein the flexible line is at least one of a metal line or a polymer line.

12. The stake system of claim 1, wherein the distal portion defines an opening formed therein configured to facilitate coupling the first end of the flexible line to the distal portion, the opening having a circular shape with a slot shape extending from the circular shape.

13. The stake system of claim 1, wherein the stake member includes a substantially flat structure with a first side surface and a second side surface and a peripheral edge therebetween, the peripheral edge defining a depth between the first side surface and the second side surface, the substantially flat structure including a bend extending along the longitudinal length of the stake member.

14. A staking system configured to be used in substantially loose material, comprising:

a stake-down object at least partially positioned above ground level; and a plurality of anchor systems, each anchor system including:

a stake member including a longitudinal length extending between a proximal end and a distal end, the stake member including a distal portion proximate to the distal end and an elongated portion longitudinally extending between the distal portion and the proximal end, the elongated portion being longitudinally longer than the distal portion, the elongated portion being integrally formed with the distal portion, the distal portion defining a first lateral width and the elongated portion defining a second lateral width, the first lateral width being larger than the second lateral width, the distal portion and at least a portion of the elongated portion configured to be forced and positioned into the loose material with the proximal end configured to remain exposed above a surface of the loose material; and a flexible line having a first end and a second end with an intermediate portion therebetween, the first end configured to be coupled to the distal portion of the stake member and configured to be below the exposed surface of the loose material, the flexible line sized and configured to cut through the loose material such that at least a portion of the intermediate portion extends tautly away from the stake member and through the loose material below the exposed surface, the second end configured to extend above the loose material and configured to be coupled to the stake-down object;

wherein the stake member is configured to maintain a substantially constant orientation relative to the exposed surface of the loose material upon the stake member being forced into the loose material and upon the flexible line being extended tautly away from the stake member at an angle ranging between about 45 degrees and about 135 degrees.

15. The staking system of claim 14, wherein the stake member comprises a bent profile so as to facilitate each stake member of the plurality of anchor systems to be stored compactly together in a nested arrangement.

16. The staking system of claim 14, wherein the stake member comprises a paddle configuration at the distal portion of the stake member.

17. The staking system of claim 14, wherein the distal portion of the stake member comprises an opening defined therein, the opening sized and configured to receive the first end of the flexible line.

18. The staking system of claim 14, wherein the flexible line comprises at least one of a metal line or a polymer line.

19. The staking system of claim 14, wherein the flexible line is configured to be removably coupled to the distal portion of the stake member.

* * * * *